US008998036B2

(12) United States Patent
Zhou et al.

(10) Patent No.: US 8,998,036 B2
(45) **Date of Patent: *Apr. 7, 2015**

(54) DISPENSER AND REFILL UNIT

(71) Applicant: Reckitt & Colman (Overseas) Limited, Berkshire (GB)

(72) Inventors: Xianzhi Zhou, Guangzhou (CN); Dong Xiao You, Dongguan (CN); Christopher Leonard Padain, Montvale, NJ (US); Jacobus Simon Petrus Van Diepen, Heidelberg (DE)

(73) Assignee: Reckitt & Colman (Overseas) Limited, Slough, Berkshire (GB)

( * ) Notice: Subject to any disclaimer, the term of this patent is extended or adjusted under 35 U.S.C. 154(b) by 0 days.

This patent is subject to a terminal disclaimer.

(21) Appl. No.: 14/087,433

(22) Filed: Nov. 22, 2013

(65) Prior Publication Data

US 2014/0084021 A1 Mar. 27, 2014

Related U.S. Application Data

(63) Continuation of application No. 13/129,164, filed as application No. PCT/GB2009/002682 on Nov. 17, 2009, now Pat. No. 8,662,356.

(30) Foreign Application Priority Data

Nov. 17, 2008 (GB) ..... 0820981

(51) Int. Cl.
*B67D 7/14* (2010.01)
*A47K 5/12* (2006.01)

(52) U.S. Cl.
CPC ..... *A47K 5/1217* (2013.01); *A47K 5/1202* (2013.01)

(58) Field of Classification Search
USPC ..... 222/52, 63, 105, 183, 325, 383, 372, 222/504, 380, 481.5, 185.1, 496, 511, 222/541.6, 153.06, 38, 153.062
See application file for complete search history.

(56) References Cited

U.S. PATENT DOCUMENTS

| | | | |
|---|---|---|---|
| 5,031,676 | A | 7/1991 | Ulm |
| 5,232,125 | A | 8/1993 | Adams |
| 5,273,083 | A | 12/1993 | Burrows |
| 5,556,005 | A | 9/1996 | Banks |
| 6,269,837 | B1 | 8/2001 | Arent |
| 6,386,403 | B2 | 5/2002 | Parsons |

(Continued)

FOREIGN PATENT DOCUMENTS

GB 2449469 A 11/2008

*Primary Examiner* — Frederick C Nicolas
(74) *Attorney, Agent, or Firm* — Troutman Sanders LLP; Ryan A. Schneider; Elizabeth-Ann Weeks

(57) ABSTRACT

A dispenser including a base unit with an actuation mechanism for dispensing liquid and a refill unit insertable into the base unit in an inverted configuration with its outlet lowermost for the supply of liquid to the base unit. The refill unit includes an annular wall projecting into the refill unit and defining an outlet from the refill unit, the annular wall being closable at its innermost end by a valve element biased onto the annular wall. The base unit includes a hollow spigot and an annular seal surrounding and spaced from the top of the spigot whereby insertion of the refill unit into the base unit causes the spigot to enter the annular wall and to lift the valve element from the annular wall to define a flow path from the refill unit, and the annular seal to seal between the spigot and the annular wall.

16 Claims, 10 Drawing Sheets

(56) References Cited

U.S. PATENT DOCUMENTS 7,898,407 B2 * 3/2011 Hufton et al. ..... 340/539.11
8,237,558 B2 * 8/2012 Seyed Momen et al. ..... 340/539.11
8,245,877 B2 * 8/2012 Ophardt ..... 222/1
8,662,356 B2 * 3/2014 Padain et al. ..... 222/325

* cited by examiner

DISPENSER AND REFILL UNIT

CROSS-REFERENCE TO RELATED APPLICATIONS

This application is a continuation of U.S. application Ser. No. 13/129,164, filed 12 Sep. 2011, which is a US National Stage of International Application No. PCT/GB2009/002682, filed 17 Nov. 2009, which claims the benefit of GB 0820981.9, filed 17 Nov. 2008, each of which are herein fully incorporated by reference.

BACKGROUND OF THE INVENTION

Field of the Invention

The present invention relates to a dispenser for dispensing a liquid soap or the like.

BRIEF SUMMARY OF THE INVENTION

The dispenser has a base unit into which a refill unit containing the material to be dispensed is fitted in an inverted configuration, namely with its outlet at the lowermost end. The present invention has been specifically designed for a free-standing soap dispenser suitable for use in a domestic environment. However, it could also be applicable to a wall-mounted unit and could be used for larger scale devices such as public lavatories. The unit may have a manually operated pump to dispense the liquid, but is preferably provided with a proximity sensor which senses the presence of the user's hand and has a pump to automatically dispense liquid.

As the device is primarily intended for the domestic market, it is essential that a consumer can replace a refill unit in a manner which is very easy, foolproof and without mess which is at best an annoyance for the consumer and at worst could destroy the dispensing mechanism.

According to the present invention, a dispenser comprises a base unit with an actuation mechanism for dispensing liquid and a refill unit insertable into the base unit in an inverted configuration with its outlet lowermost for the supply of liquid to the base unit, the refill unit comprising an annular wall projecting into the refill unit and defining an outlet from the refill unit, the annular wall being closable at its innermost end by a valve element biased onto the annular wall, the base unit comprising a hollow spigot and an annular seal surrounding and spaced from the top of the spigot, whereby insertion of the refill unit into the base unit causes the spigot to enter the annular wall and to lift the valve element from the annular wall to define a flow path from the refill unit, through at least one cut-out portion formed in the top of the spigot and/or the bottom of the valve element and down the hollow spigot, and the annular seal to seal between the spigot and the annular wall, wherein the activation mechanism comprises a pump selectively operable to pump a metered dose of liquid along a dispensing tube and out of a dispensing head; a proximity sensor in the form of a capacitive sensor; and control circuitry to react to a signal from the proximity sensor to activate the pump.

Such an arrangement provides a mechanism by which the refill unit can simply be lowered onto the spigot. This causes the flow path to be opened up. During the opening process, the annular seal forms a seal with the annular wall thereby preventing leakage even during the opening process.

The present invention therefore provides a simple and mess free way of replacing the refill unit even when the refill has not been completely emptied.

The cut-out portion could be formed in the bottom of the valve element. However, this would also require the valve seat to be shaped to match the cut-out portion on the valve element. It is therefore preferable for the cut-out portion to be on the top of the spigot. Preferably, there is more than one cut-out portion to provide a plurality of flow paths. In the preferred example, the cut-out portions effectively take the form of castellations on the top of the spigot.

The valve element could be biased by a spring which is on the opposite side of the valve element from the annular wall. However, preferably, the valve element is biased by at least one resilient member which is preferably joined at one end to the valve element and at the other end at a location radially outwardly of and below the innermost end of the annular wall, the or each resilient member being configured so that when the valve element is lifted from the annular wall, a flow path is present between the valve element and the annular wall.

By using at least one resilient member anchored outside of the annular wall, the structure of the device can be greatly simplified as the resilient elements themselves and the means by which they are anchored can be integrated into the existing structure of the refill unit. If the valve element was to be resiliently supported on its opposite side, then an additional structure would be required to support this, thereby complicating the design.

This forms an independent aspect of the present invention which can be defined in its broadest sense as a refill unit for a dispenser, the unit comprising an opening at one end which, in use, is the lowermost end, the opening comprising an annular wall projecting into the unit and being closable at its innermost end by a valve element biased onto the annular wall, wherein the valve element is biased by at least one resilient member with joined at one end to the valve element and at the other end to a location radially outwardly of and below the innermost end of the annular wall, the or each resilient member being configured so that, when the valve element is lifted from the annular wall, a flow path is present between the valve element and the annular wall.

If only a single biasing element is used, it could not be a continuous annular component, but would have to have holes in or be a helical structure, or similar, so that the flow path could be present. Preferably, there are a plurality of resilient elements with gaps therebetween to provide the flow path.

The or each resilient member may be manufactured separately from the valve element and fixed together. However, preferably, the valve element is manufactured integrally with the or each resilient member.

The or each resilient member preferably extends into a surrounding valve plate which is secured to the cap of the refill unit.

The valve plate may simply be glued, adhered or otherwise fixed within the cap. However, preferably, the valve plate is sandwiched between the cap and a fixing plate. Preferably, one or more fixing posts are provided in one of the cap, valve plate or fixing plate in order to locate the various elements with respect to one another.

The opening in the refill unit may be a liquid outlet or an air relief inlet. The structure of the annular wall, valve element and resilient member is equally applicable to either.

These and other objects, features and advantages of the present invention will become more apparent upon reading the following specification in conjunction with the accompanying drawing figures.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF THE INVENTION

Figure 1:
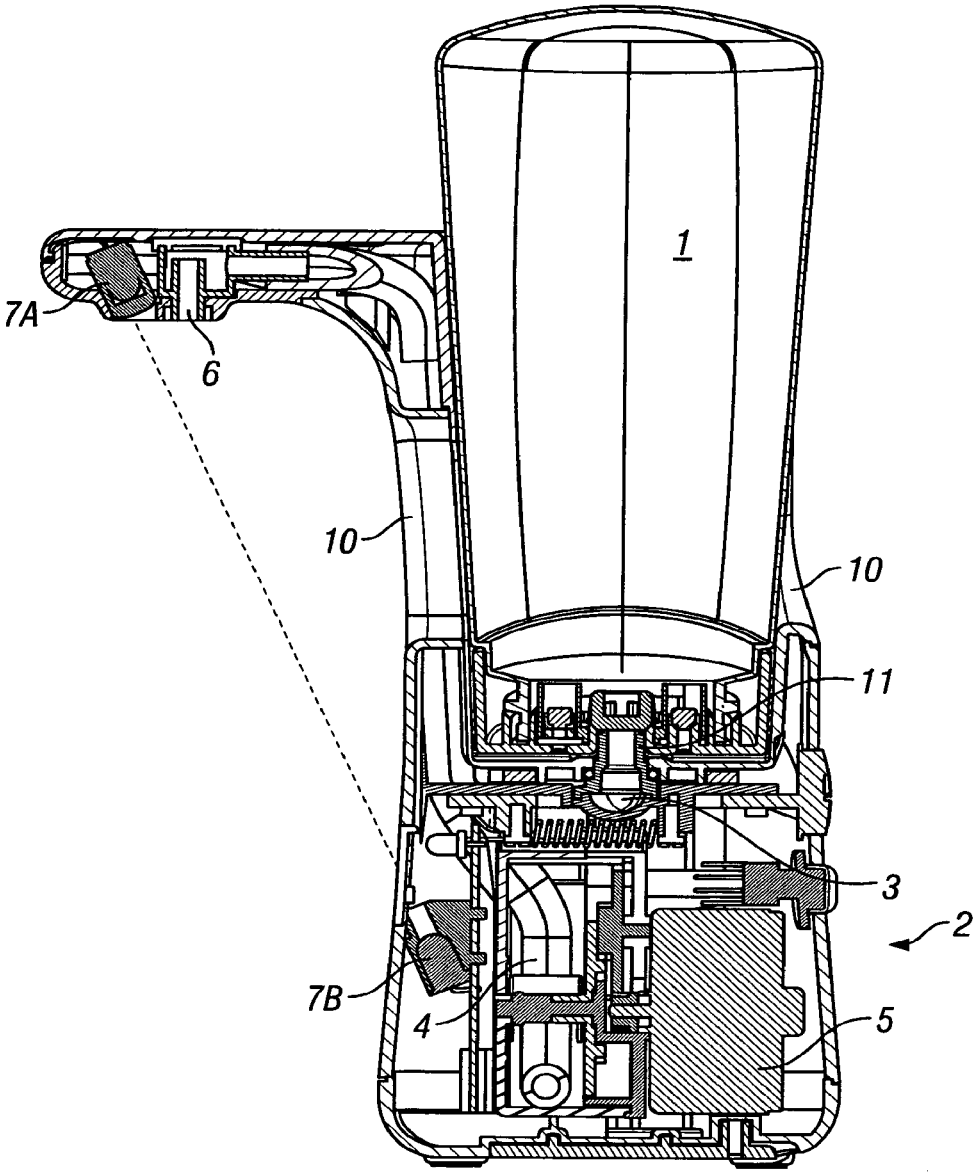
FIG. 1 is a cross-section through a dispenser with an infrared sensor in place of the capacitive sensor of the invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

The dispenser is a hands-free dispenser which is generally suitable for domestic use. The dispenser is primarily intended to dispense liquid soap, but may also be used to dispense other liquid or semi-liquid products (ideally with a viscosity greater than water), such as hand cream, body lotion, moisturizer, face cream, shampoo, shower gel, foaming hand wash, shaving cream, washing up liquid, toothpaste or a sanitizing agent such as alcohol gel.

The dispenser comprises two main parts, namely a refill 1 and a base unit 2. The refill 1 provides a reservoir of liquid to be dispensed and is fitted to the base unit 2 as set out below.

The base has an interface 3 into which liquid is dispensed from the refill unit. The interface 3 is in fluid communication with a dispensing tube 4. A pump 5 is selectively operable to pump a metered dose of the liquid along dispensing tube 4 and out of dispensing head 6.

The base has an infrared transmitter 7A which transmits an infrared beam through a window 8 to a receiver 7B to sense the presence of a user's hands in the vicinity of the dispenser. Control circuitry reacts to a signal from the proximity sensor to activate the pump. The illustrated sensor is a break beam sensor, but may also be a reflective sensor. Although an infrared sensor is shown and described, this is replaced by a capacitive sensor in the present invention. The device may be mains powered or battery powered.

The interface between the refill 1 and base unit 2 will now be described in greater detail with reference to FIGS. 2 to 10.

The base unit 2 comprises a cowling 10 which forms a cup-shaped housing surrounding a significant portion of the refill to protect and support it. A spigot 11 projects through the base of the cowling 10 and is sealed to the cowling 10 by an O-ring seal 12. The spigot has a plurality of castellations 13 in its top surface. A second O-ring seal 14 surrounds the spigot 11 beneath the castellations 13.

The refill 1 comprises a bottle 20 to which a cap 21 is fixed. The bottle 20 has a neck 22 which fits over and seals with an annular flange 23 within the cap 21. The cap 21 has an upwardly depending skirt 24 (when in the inverted orientation shown in the drawings) which forms the outer surface of the cap. Working inwardly from the skirt 24, the next feature of the cap is an outer annular wall 25 which is generally co-axial with the skirt 24.

This is shown in detail in FIGS. 5 to 10.

Figure 2:
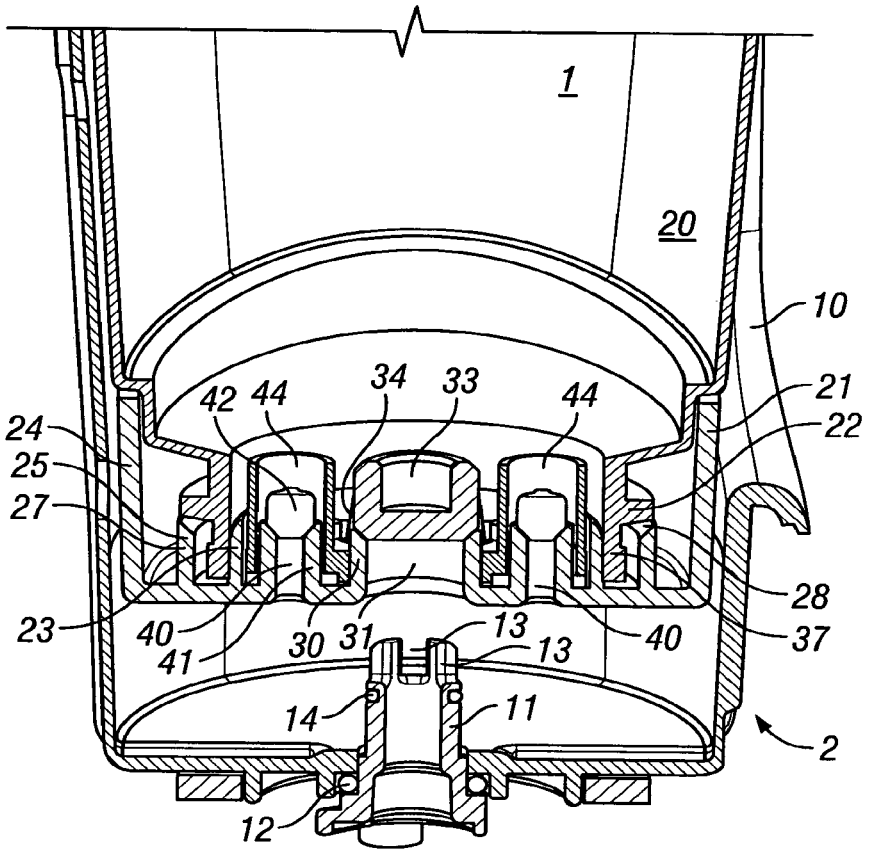
FIG. 2 is a cut-away perspective view of the refill being introduced into the dispenser but not yet being engaged.
Figure 5:
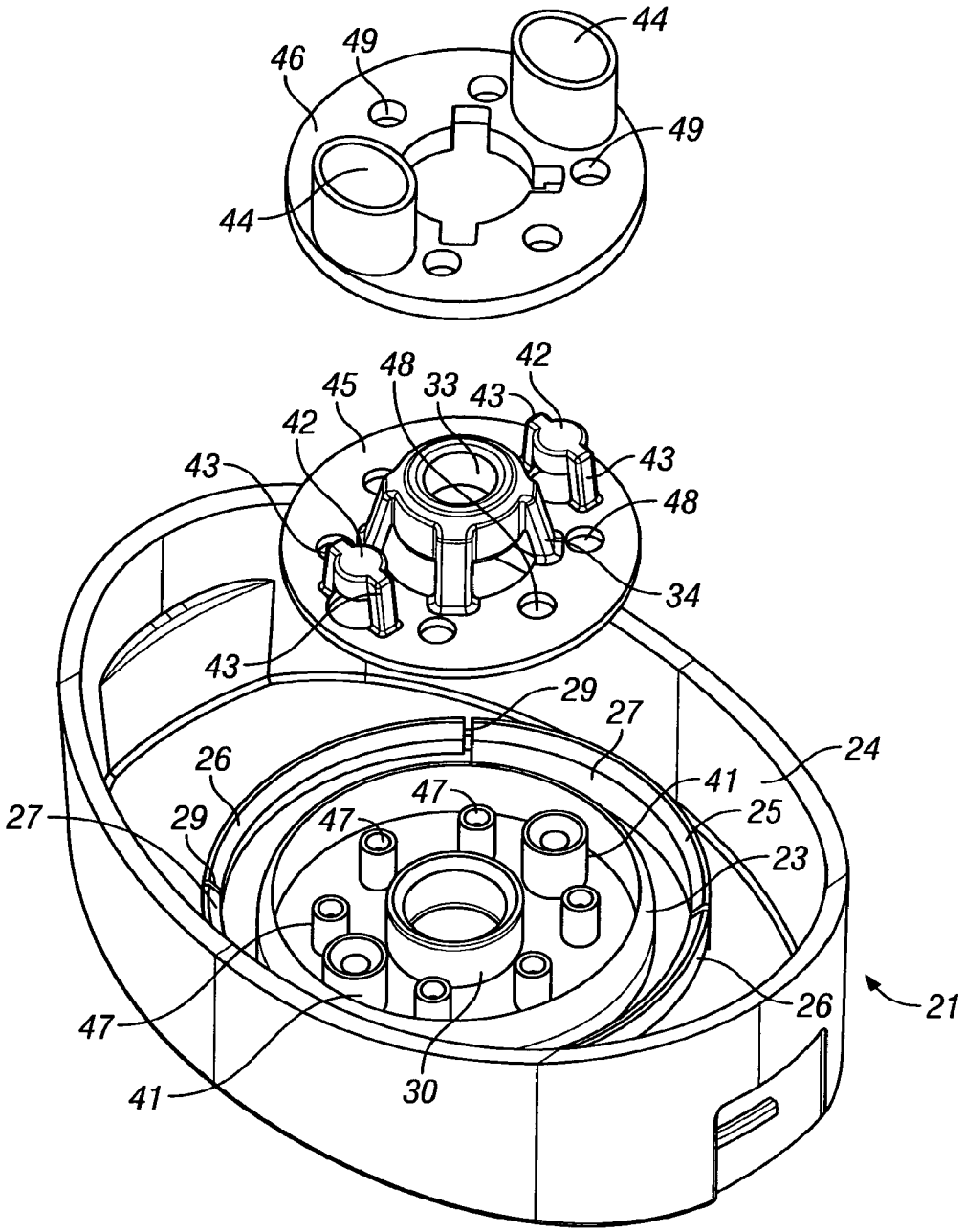
FIG. 5 is a perspective view of the cap assembly prior to assembly.
Figure 6:
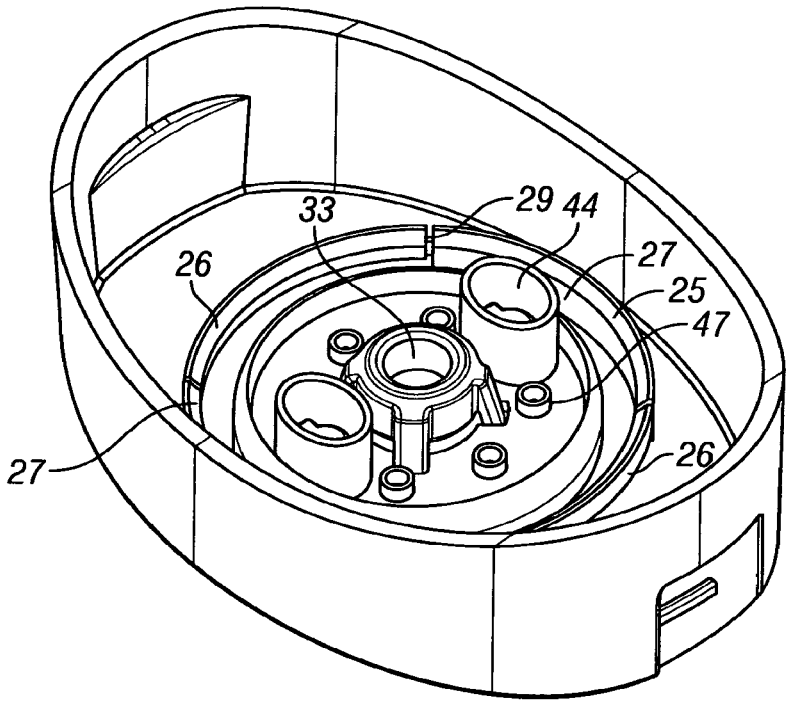
FIG. 6 is a perspective view of the cap assembly after assembly.
Figure 7:
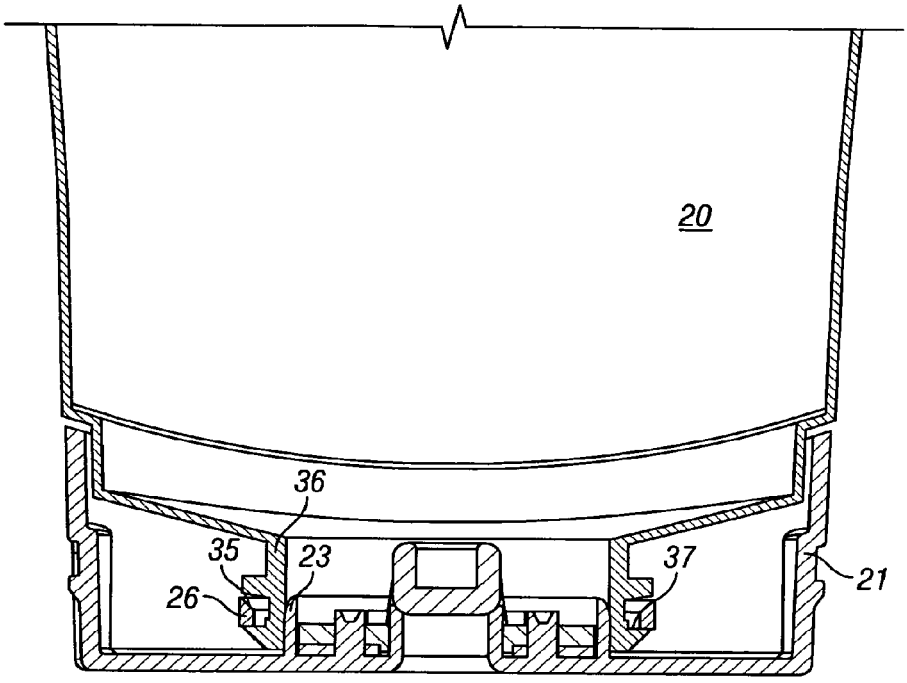
FIG. 7 is a cross-section showing the engagement between the bottle neck and cap assembly.
Figure 8:
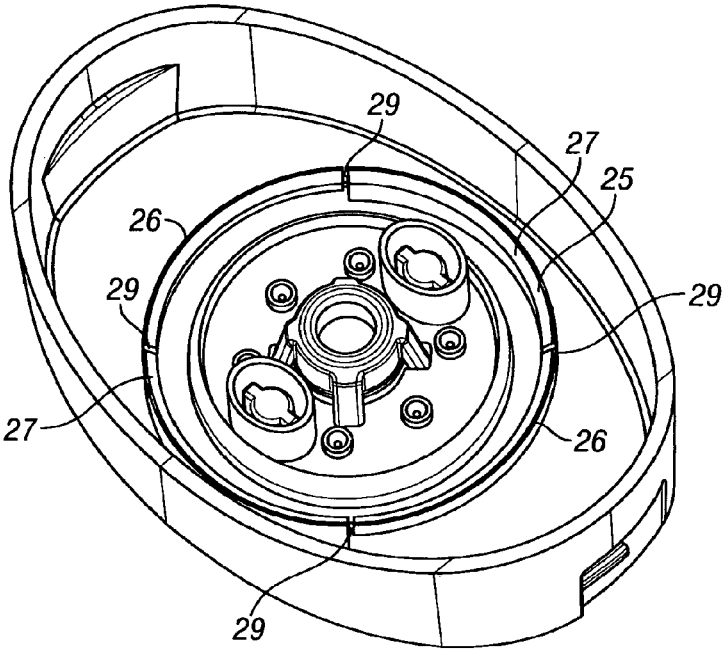
FIG. 8 is a perspective view of the cap with the frangible members intact.
Figure 9:
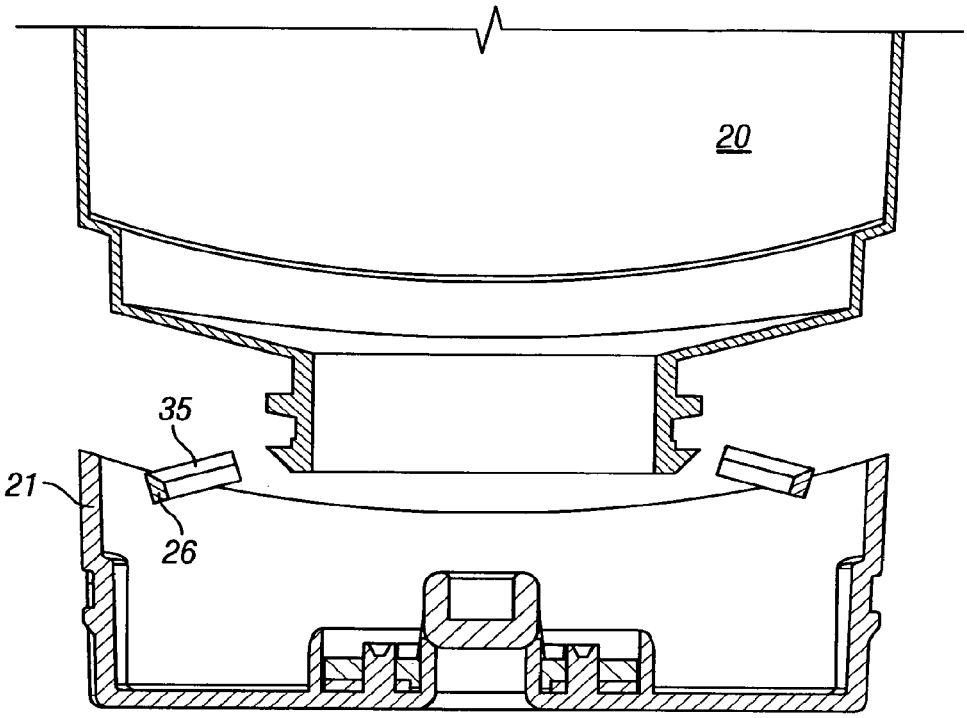
FIG. 9 is a view similar to FIG. 7 after the bottle has been removed from the cap.

The outer annular wall 25 consists of a pair of retaining members 26 and a pair of support members 27 which alternate with one another and each extend for approximately a quarter of the circle as shown in FIGS. 5, 6, 8 and 10. The profile of the support members 27 is as shown in FIG. 2. These members extend directly up from the lower wall of the cap, are parallel sided and have an inclined upper surface 28. The profile of the retaining members 26 is shown in FIGS. 7 and 9. Unlike the support members 27, these are not fixed to the wall of the cap. Instead, they are fixed at either end to the support members 27 by frangible members 29 as best shown in FIGS. 6 and 8. The retaining members 26 are parallel sided and have an inclined upper surface 35 as shown in FIGS. 7 and 9.

As shown in FIGS. 7 and 9, the neck 22 of the bottle has an inclined outer surface 36 which is complimentary to the inclined surfaces 28 and 35 of the annular wall 25. Behind the inclined outer surface 36 is a shoulder 37 which faces the main body of the bottle 20. This inclined outer surface 36 and shoulder 37 is only present in the vicinity of the retaining members 26 and not in the vicinity of the support members 27. Adjacent to the support members 27, the neck 22 has a parallel sided configuration as shown in FIG. 2.

Figure 10:
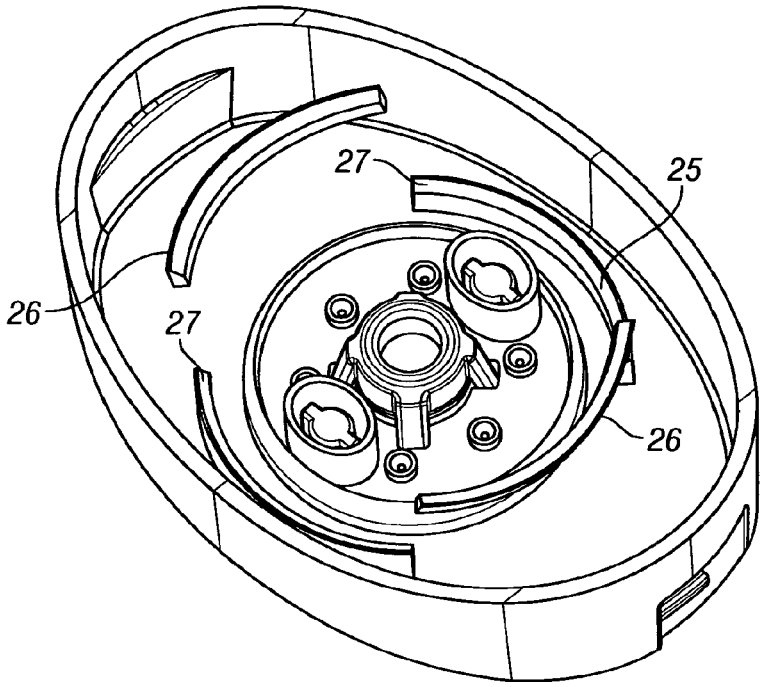
FIG. 10 is a view similar to FIG. 8 after the frangible members have broken off.

In order to insert the bottle 20 into the cap 21, the bottle 20 is pushed down with its neck fitting over the annular flange 23. The inclined outer surface 36 of the bottle co-operates with the inclined surfaces 28, 35 to displace the retaining members 26 radially outwardly until the shoulder 37 snaps into place behind the retaining members 26 as shown in FIG. 7. When the bottle 20 is pulled off of the cap 21, the shoulders 37 bear against the retaining members 26, thereby breaking frangible members 29 so that the retaining members 26 become detached from the cap 21 as shown in FIGS. 9 and 10. Once this has happened, it is no longer possible to retain the cap on a bottle, thereby preventing subsequent use of the refill 1.

It should be noted that it is not necessary for both of the retaining members 26 to become fully detached from the lid. It is possible that only one of these becomes detached, or that one or both are simply displaced to a location at which they can no longer engage with the neck of the bottle.

Returning now to FIGS. 2 to 4, the liquid outlet and associated valve will now be described.

The liquid outlet from the reservoir is provided by an annular wall 30 surrounding a central opening 31. At the top of the annular wall 30 is an inclined surface 32 (see FIG. 4) which provides a valve seat for outlet valve element 33. This is shown in the form of a U-shape cup-like member, but may equally be a solid member or a hollow ball-like member. The outlet valve element 33 is biased into its closed position by a plurality of biasing elements 34. These are attached at their upper end towards the top of the valve element 33 and are attached at their lower ends at a location radially outward of the annular wall 30 and below the top of the annular wall 30. They are preferably formed integrally with the valve element 33.

Figure 3:
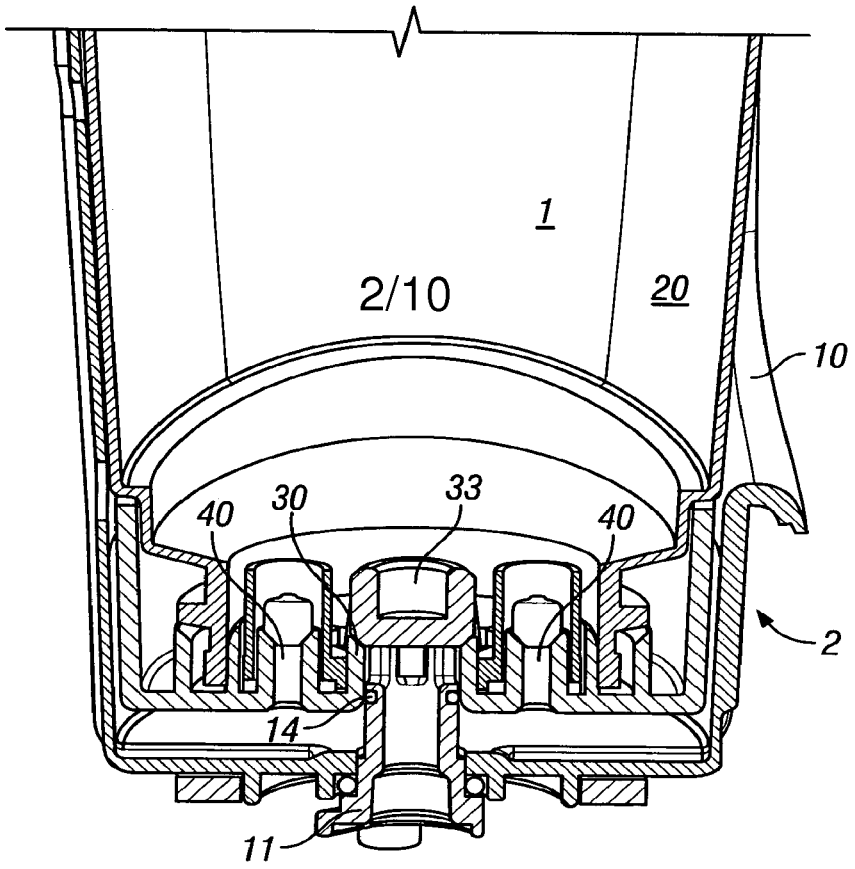
FIG. 3 is a view similar to FIG. 2 showing the refill in an intermediate position.
Figure 4:
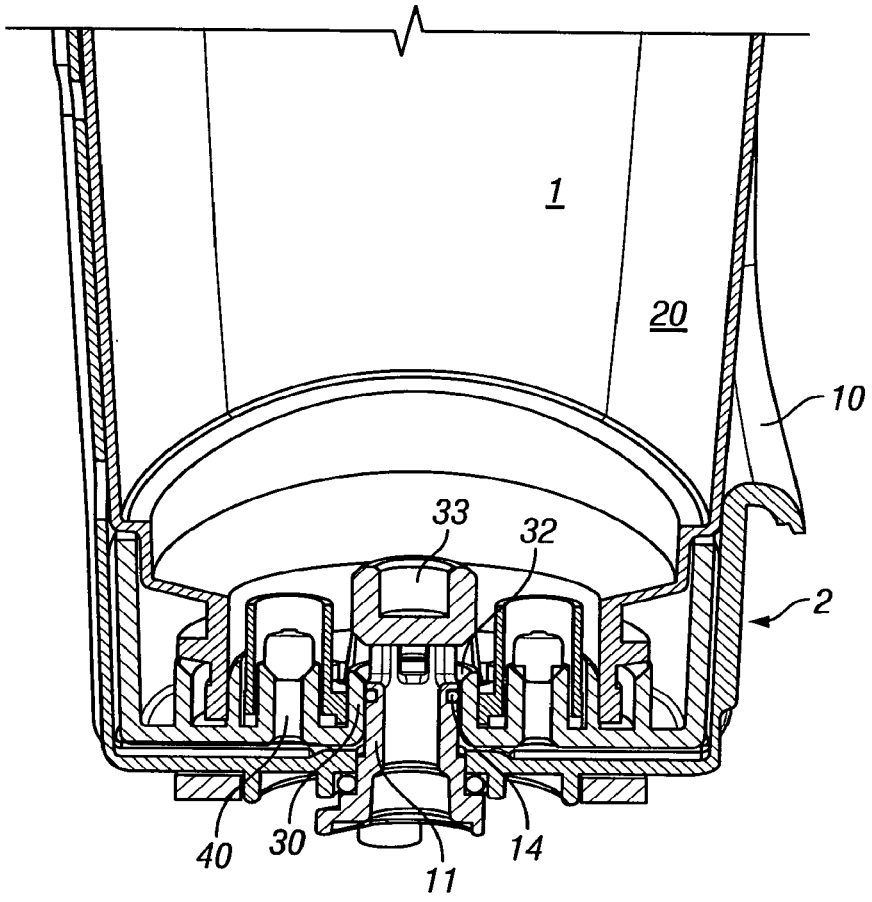
FIG. 4 is a view similar to FIGS. 3 and 4 showing the refill in its fully engaged position.

As shown in FIGS. 2 to 4, when the refill 1 is lowered into the base unit 2, the spigot 11 engages with the lower surface of the valve element 33 as shown in FIG. 3. Further downward movement of the refill causes the valve element 33 to be lifted from its seat, and also brings the O-ring 14 into sealing engagement with the annular wall 30. The valve element 33 is lifted to the position shown in FIG. 4. In this position, liquid in the bottle 20 can flow around the biasing elements 34, and enter the spigot via the castellations 13 and hence flow into the base unit 2. Liquid is prevented from escaping between the spigot 11 and annular wall 30 by the O-ring seal 14. This arrangement offers a simple and mess-free way for a consumer to insert a refill regardless of the fill level of the refill.

In order to remove a refill, the consumer lifts it out of the base whereupon the biasing elements 34 cause the valve element 33 to return to the seat 32. During this movement, the seal between the spigot 11 and annular wall 30 is maintained by the O-ring seal 14. A spent refill is then replaced by a new one following the above procedure.

The cap is provided with a pair of pressure relief valves 40. Each is formed by an annular boss 41 integral with the cap 21. A pressure relief valve element 42 is seated on the top of the annular boss 41 and is biased in place by a pair of biasing elements 43 (as shown, for example, in FIG. 5). The biasing force is such that, under normal conditions, the pressure relief valve element 42 forms an air tight seal on the boss 41. However, when the pressure within the bottle 20 drops below a certain level, the pressure differential across the relief valve element 42 is sufficient to overcome the force exerted by biasing elements 43 and to allow air into the bottle 20. This reduces the pressure differential thereby restoring the air tight seal without leakage of fluid.

Each pressure relief valve 40 is surrounded by an annular barrier 44 which extends axially to a level axially above the level of the top of the annular wall 30. Thus, when the valve element 33 is open, any air entering the relief valve 40 will not become entrained in the outgoing liquid stream. In practice, this means that the relief valve can be placed closer to the outlet, thereby resulting in a more compact cap. Although two relief valves are shown, a single valve, or more than two valves could be provided if necessary.

The manner in which the cap is assembled is illustrated in FIGS. 5 and 6.

The assembly is a three-part structure consisting of the cap 21, a valve plate 45 and a fixing plate 46. The cap has a number of molded features including the annular flange 23, annular wall 25 and annular bosses 41. In addition, the cap 21 has a plurality of fixing posts 47.

The valve plate 45 is an elastomeric material and is integrally formed with the valve element 33, biasing elements 34, relief valve element 42 and biasing elements 43. The valve plate has a plurality of locating holes 48 which correspond to the fixing posts 47.

The fixing plate 46 is made of a rigid plastics material and is integrally formed with the annular barrier 44. As with the valve plate 45, the fixing plate 46 is also provided with a plurality of locating holes 49 which correspond to the fixing posts 47.

To assemble the cap, the three components are placed on top of one another as shown in FIG. 6 with the fixing posts entering the locating holes to ensure that the components are correctly aligned. Heat or adhesive is then applied to the top of the fixing posts 47 to secure the fixing posts to the fixing plate 46. The elastomeric valve plate 45 is thereby sandwiched between the cap 21 and fixing plate 46 which holds the valve elements 33 and 42 in position.

A second example of a cap for a refill unit will now be described with reference to FIGS. 11 to 14.

The structure of the outlet valve element 33 in the second example is essentially the same as the first example, and will not be described again in relation to the second example.

Figure 11:
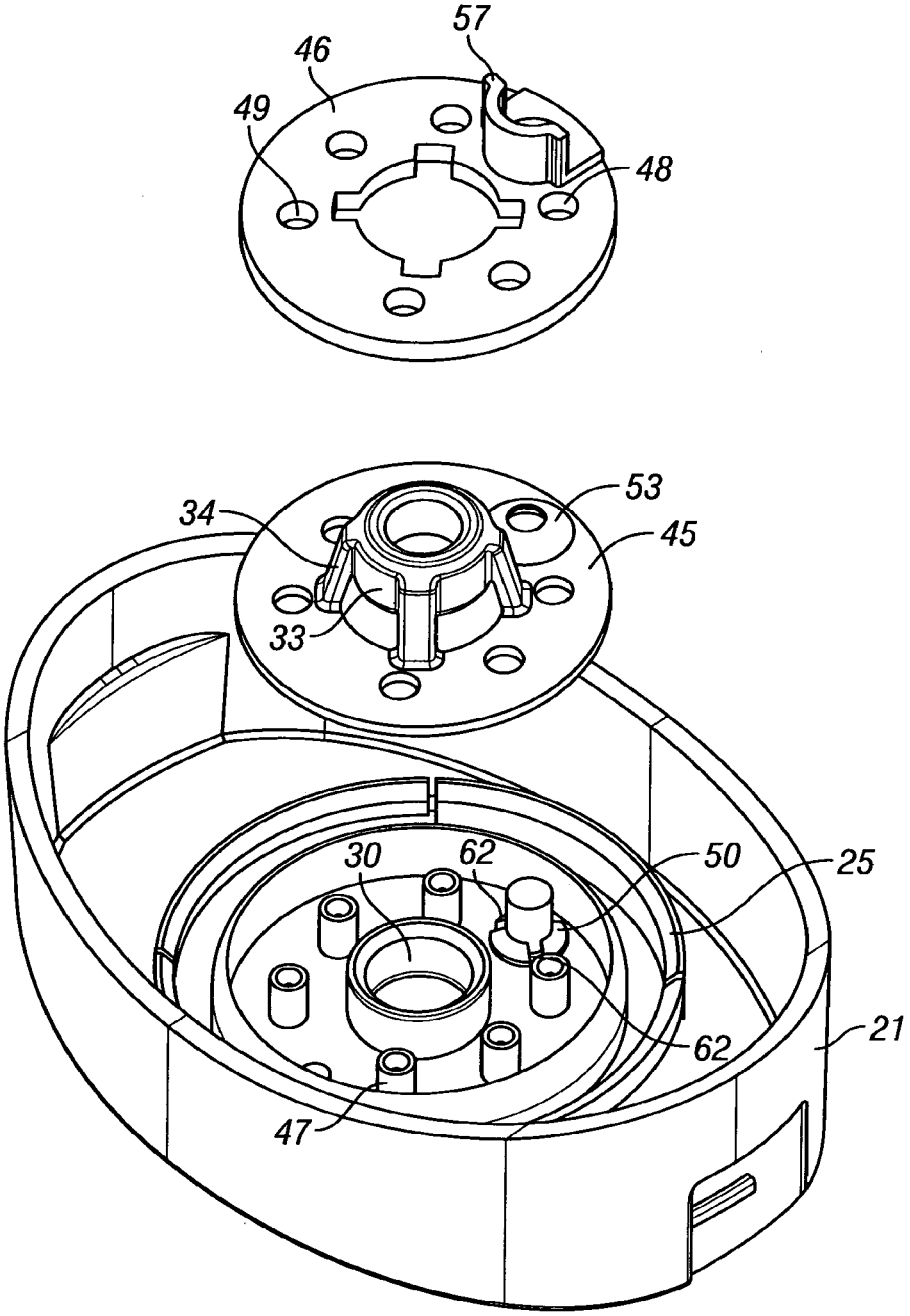
FIG. 11 is an exploded perspective view of a cap of a second refill unit.
Figure 12:
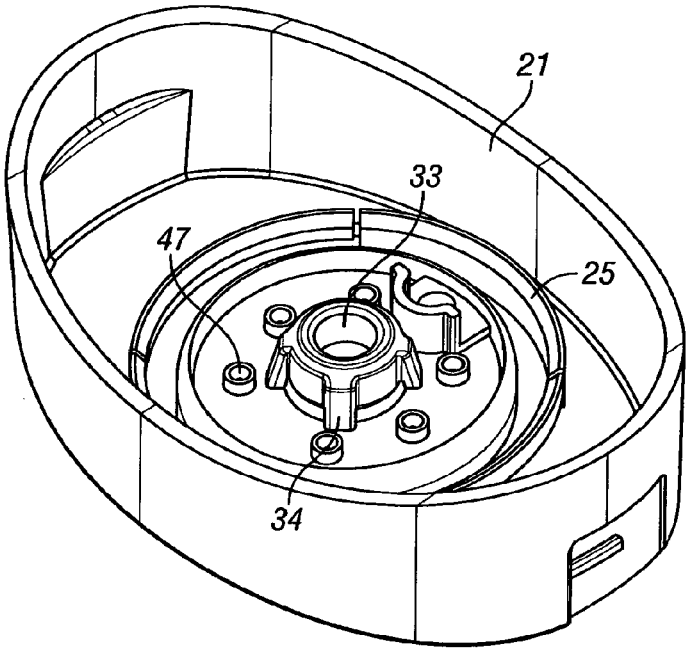
FIG. 12 is a view similar to FIG. 11 showing the assembled cap.

As can be seen from FIG. 11, the cap 21 is integrally molded with a number of features, such as the annular walls 25 and 30 and a conical part 50 of the pressure relief valve which will be described below. A resilient lip 53 (described in more detail below) for the pressure relief valve is provided integrally molded with the valve plate 45. The fixing plate 46 is also provided with a shield 57 for the relief valve. This is equivalent to the barrier 44 in FIG. 2, but only extends around the side of the relief valve facing the outlet valve element 33. The barrier 44 and shield 57 could be used interchangeably in the two examples.

The cap assembly is assembled in the same manner as in the first example.

Figure 13:
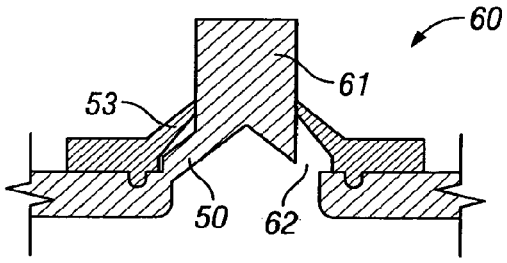
FIG. 13 is a cross-sectional view through the pressure relief valve of the second example.
Figure 14:
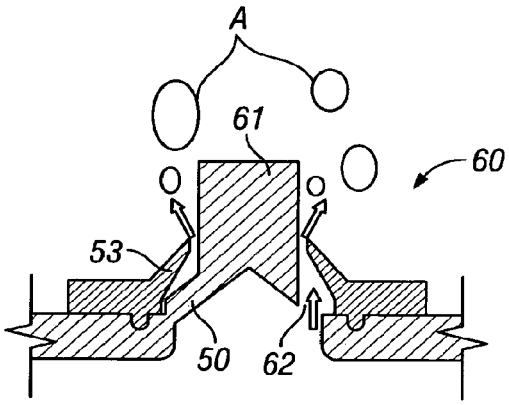
FIG. 14 is a view similar to FIG. 13 showing the pressure relief valve in an open configuration to allow the flow of air.

The pressure relief valve 60 is illustrated in FIGS. 13 and 14.

The valve has the conical part 50 which is an integral part of the cap 21 as mentioned above. At the top of the conical part 50 is a cylindrical post 61. The resilient lip 53 is effectively a hollow frustoconical extension of the valve plate 52 of resilient material which extends along the conical part 50 from which it diverges slightly and is a tight fit against the post 61. At least one air inlet 62 (also shown in FIG. 11) passes through the wall of the conical part 50 and is normally covered by the resilient lip 53 as shown in FIG. 11. When the pressure in the bottle 20 falls as liquid is emptied the pressure differential across the resilient lip 53 will eventually become sufficient to displace the lip 53 to a sufficient degree to allow air A into the bottle 20 as shown by the arrows in FIG. 8. It should be noted that the degree to which the resilient lip 53 lifts from the conical element 50 has been exaggerated in FIG. 8 and that, in practice, this will be almost imperceptible.

Instead of sealing against the post, the resilient lip 53 may seal against the conical part 50. In this case, the lip will not diverge from the conical part as shown. Instead, it would actually have an angle of incline less than the angle of the conical part 50 so as to be naturally biased onto the conical part.

Numerous characteristics and advantages have been set forth in the foregoing description, together with details of structure and function. While the invention has been disclosed in several forms, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved as they fall within the breadth and scope of the claims here appended.

What is claimed is:

1. A dispenser and refill unit comprising:

a base unit with an actuation mechanism for dispensing liquid; and a refill unit insertable into the base unit in an inverted configuration with an outlet lowermost for the supply of liquid to the base unit;

the activation mechanism comprising:

a pump selectively operable to pump a metered dose of liquid along a dispensing tube and out of a dispensing head;

a proximity sensor in the form of a capacitive sensor; and control circuitry to react to a signal from the proximity sensor to activate the pump;

the refill unit comprising an annular wall projecting into the refill unit and defining an outlet from the refill unit, the annular wall being closable at an innermost end by a valve element biased onto the annular wall; and the base unit comprising a hollow spigot and an annular seal surrounding and spaced from the top of the spigot whereby insertion of the refill unit into the base unit causes the spigot to enter the annular wall and to lift the valve element from the annular wall to define a flow path from the refill unit, through one or both of at least one cut-out portion formed in the top of the spigot and the bottom of the valve element and down the hollow spigot, and the annular seal to seal between the spigot and the annular wall.

2. The dispenser and refill unit as claimed in claim 1, wherein the refill unit is filled with a liquid having a viscosity greater than water.

3. The dispenser and refill unit according to claim 1, wherein the valve element is biased onto the annular wall by at least one resilient member.

4. The dispenser and refill unit according to claim 3, wherein the at least one resilient member is joined at one end to the valve element and at the other end at a location radially outwardly of and below the innermost end of the annular wall, the at least one resilient member being configured so that when the valve element is lifted from the annular wall, a flow path is present between the valve element and the annular wall.

5. The dispenser and refill unit according to claim 3 comprising a plurality of resilient elements with gaps therebetween to provide the flow path.

6. The dispenser and refill unit according to claim 3, wherein the valve element is manufactured integrally with the at least one resilient member.

7. The dispenser and refill unit according to claim 6, wherein the at least one resilient member extends into a surrounding valve plate which is secured to the cap of the refill unit.

8. The dispenser and refill unit according to claim 7, wherein the valve plate is sandwiched between the cap and a fixing plate.

9. The dispenser and refill unit according to claim 8 further comprising one or more fixing posts provided in one of the cap, valve plate or fixing plate in order to locate the various elements with respect to one another.

10. A dispenser and refill unit comprising:

a base unit with an actuation mechanism for dispensing liquid; and a refill unit insertable into the base unit in an inverted configuration with the refill unit's outlet lowermost for a supply of liquid to the base unit;

wherein the refill unit comprises an annular wall projecting into the refill unit and defining an outlet from the refill unit, the annular wall being closable at an innermost end of the annular wall by a valve element biased onto the annular wall;

wherein the base unit comprises a hollow spigot and an annular seal surrounding and spaced from a top of the spigot whereby insertion of the refill unit into the base unit causes the spigot to enter the annular wall and to lift the valve element from the annular wall to define a flow path from the refill unit, through one or both of at least one cut-out portion formed in the top of the spigot and a bottom of the valve element and down the hollow spigot, and the annular seal to seal between the spigot and the annular wall; and wherein the activation mechanism comprises a pump selectively operable to pump a metered dose of liquid along a dispensing tube and out of a dispensing head, a proximity sensor in the form of a capacitive sensor, and control circuitry to react to a signal from the proximity sensor to activate the pump.

11. A dispenser and refill unit comprising:

a base unit with an actuation mechanism for dispensing a liquid; and a refill unit containing the liquid to be dispensed;

the activation mechanism comprising:

a pump selectively operable to pump a metered dose of liquid along a dispensing tube and out of a dispensing head;

a proximity sensor in the form of a capacitive sensor; and control circuitry to react to a signal from the proximity sensor to activate the pump;

the refill unit comprising:

a bottle to which a cap is fixed; and a liquid outlet through the cap provided by an annular wall projecting into the refill unit and surrounding a central opening;

the liquid outlet being closable by an outlet valve element biased into a closed position onto the annular wall by at least one resilient member;

wherein the outlet valve element is manufactured integrally with the at least one resilient member, and the at least one resilient member is integrally formed with a valve plate which is secured to the cap of the refill unit;

where upon the refill unit being inverted and inserted into the base unit to supply the liquid to be dispensed to the base unit, the liquid outlet is at a lowermost end of the refill unit; and the base unit comprising a hollow spigot whereby insertion of the refill unit into the base unit causes the spigot to enter the liquid outlet and to lift the outlet valve element from the annular wall to define a flow path from the refill unit to the base unit, through at least one castellation formed in the spigot.

12. The dispenser and refill unit according to claim 11, wherein the at least one resilient member is joined at one end to the outlet valve element and at the other end at a location radially outwardly of and below the innermost end of the annular wall, the at least one resilient member being configured so that when the outlet valve element is lifted from the annular wall, a flow path is present between the outlet valve element and the annular wall.

13. The dispenser and refill unit according to claim 11 comprising a plurality of resilient members with gaps therebetween to provide the flow path.

14. The dispenser and refill unit according to claim 11, wherein the valve plate is sandwiched between the cap and a fixing plate.

15. The dispenser and refill unit according to claim 11, wherein the liquid contained within the refill unit has a viscosity greater than water.

16. The dispenser and refill unit according to claim 14 further comprising one or more fixing posts provided in one of the cap, valve plate or fixing plate in order to locate the cap, valve plate and fixing plate with respect to one another.

* * * * *